US006155456A

United States Patent [19]

Archer

[11] Patent Number: 6,155,456

[45] Date of Patent: Dec. 5, 2000

[54] CARD HOLDER AND DISPENSER

[75] Inventor: David Archer, Barrington, R.I.

[73] Assignee: Archer Design, Inc., Birmingham, Mich.

[21] Appl. No.: 09/118,848

[22] Filed: Jul. 20, 1998

[51] Int. Cl.[7] ..... B65H 1/08

[52] U.S. Cl. ..... 221/231; 221/259

[58] Field of Search ..... 221/226, 231, 221/42, 43, 259, 277, 279

[56] References Cited

U.S. PATENT DOCUMENTS

| | | | |
|---|---|---|---|
| 479,688 | 7/1892 | Weller . | |
| 599,821 | 3/1898 | Adkins | 221/231 |
| 847,688 | 3/1907 | Plummer . | |
| 933,663 | 9/1909 | Pollock | 221/43 |
| 937,584 | 10/1909 | Fitch, Jr. . | |
| 1,088,142 | 2/1914 | Gardner . | |
| 1,131,112 | 3/1915 | Brown . | |
| 1,276,493 | 8/1918 | Cooke . | |
| 1,326,926 | 1/1920 | Gray . | |
| 1,734,644 | 11/1929 | Ostrander et al. . | |
| 2,288,979 | 7/1942 | Testi . | |
| 3,117,694 | 1/1964 | Gothreau . | |
| 3,154,216 | 10/1964 | Snow et al. . | |

FOREIGN PATENT DOCUMENTS

| | | | |
|---|---|---|---|
| 47 863 | 4/1937 | France | 221/43 |

*Primary Examiner*—Kenneth W. Noland
*Attorney, Agent, or Firm*—Salter & Michaelson

[57] ABSTRACT

A card holder and dispensing device includes a housing defining a cavity for receiving a plurality of cards therein. The front wall of the housing has an opening formed therein for loading and removing cards from the cavity of the housing, and the top wall of the housing functions as an exit rail for causing dispensing of the cards from the cavity of the housing one at a time. A roller mechanism is rotatably mounted to the front wall of the housing for dispensing of the cards from the cavity of the housing through the front wall window opening and over the top edge of the exit rail of the housing. A bow spring is positioned within the cavity of the housing for biasing the cards upwardly against the roller mechanism, wherein actuation of the roller mechanism dispenses the business cards one at a time from the cavity of the housing. An important feature of the invention is the fact that the top edge of the exit rail is located above the working surface of the roller mechanism to insure that when the top-most card is dispensed, the leading edge thereof will engage the wall surface of the exit rail and then slide upwardly and over the edge of the exit rail.

7 Claims, 5 Drawing Sheets

CARD HOLDER AND DISPENSER

BACKGROUND AND SUMMARY OF INVENTION

This invention relates to a business card holder and dispensing device which is capable of holding a plurality of business cards and effectively dispensing them one at a time. The business card holder includes a bow spring which biases the business cards upwardly against a roller. When the user actuates the roller, it feeds the uppermost card outwardly against a curved exit rail located adjacent the top of the holder. The top of the exit rail is positioned slightly higher than the uppermost card within the body of the holder, so that when the roller mechanism is actuated, the top card slides up and over the rail. The remaining cards are retained within the body of the holder by the rail. The dimensional relationship between the holder's exit rail and the roller mechanism provides for an arrangement which allows one card at a time to be stripped from the exit location of the holder while effectively maintaining the remaining cards within the body of the holder.

Much of the working public uses business cards in order to help promote their business or profession, and distribute pertinent phone, fax, and e-mail information. It is common procedure during initial business meetings for the participants to shake hands and exchange business cards. Traditionally, a person will keep a small number of business cards in a dedicated compartment in their wallet in order to have them handy during scheduled or unexpected meetings. The problem associated with carrying the cards in one's wallet is that the cards become bent and are sometimes difficult to access which causes fumbling that may be embarrassing. Devices for holding and distributing cards are well known in the prior art; however, such devices lack the advantageous structural features and characteristics associated with the card holder and dispenser of the instant invention. The card holder and dispenser of the instant invention is compact in size so that it may be easily carried within the user's pocket and has a finger operated roller mechanism which quickly and easily dispenses one card at a time from the housing of the dispenser.

More specifically, the device includes a housing which defines a cavity for receiving a plurality of stacked business cards therein. The housing has opposing front and back walls, opposing side walls, and opposing top and bottom walls. The front wall has an opening formed therein for loading and unloading cards from the cavity of the housing, and the top wall functions as an exit rail which permits dispensing of business cards from the housing one card at a time, while retaining the remaining cards within the housing. A roller mechanism is rotatably mounted to the front wall of the housing, actuation of which causes dispensing of the top card from the stack of cards within the housing through the front wall opening and over the top edge of the exit rail. A bow or leaf spring is mounted within the cavity of the housing for biasing the stack of cards upwardly against the roller mechanism.

Accordingly, among the several objects of the instant invention are: the provision of a card holder and dispensing device which effectively holds a plurality of business cards and neatly dispenses them one at a time from the housing of the holder; the provision of a card holder which has a unique finger operated rolling mechanism which feeds the cards outwardly against a curved exit rail; the provision of a card holder which is compact in size so that it may easily be carried in the pocket of the user; and the provision of a card holder which is neat and attractive in appearance and the provision of a card holder which is cost efficient and easy to manufacture.

Other objects, features, and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
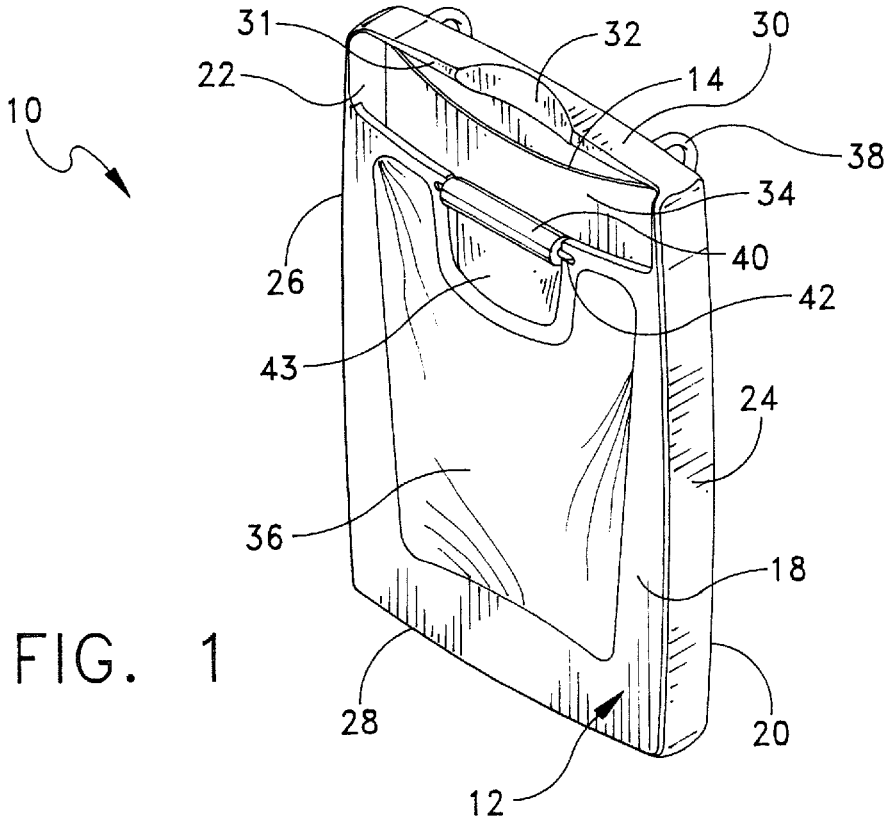
FIG. 1 is a perspective view showing the business card holder and dispensing device of the instant invention.

Referring now to the drawings, and more particularly to FIG. 1, the card holder and dispensing device of the instant invention is shown and generally indicated at 10. As will hereinafter be more fully described, the instant invention provides for a card holder and dispensing device which is capable of receiving a plurality of business cards and effectively dispensing them one at a time from the housing of the case.

Figure 2:
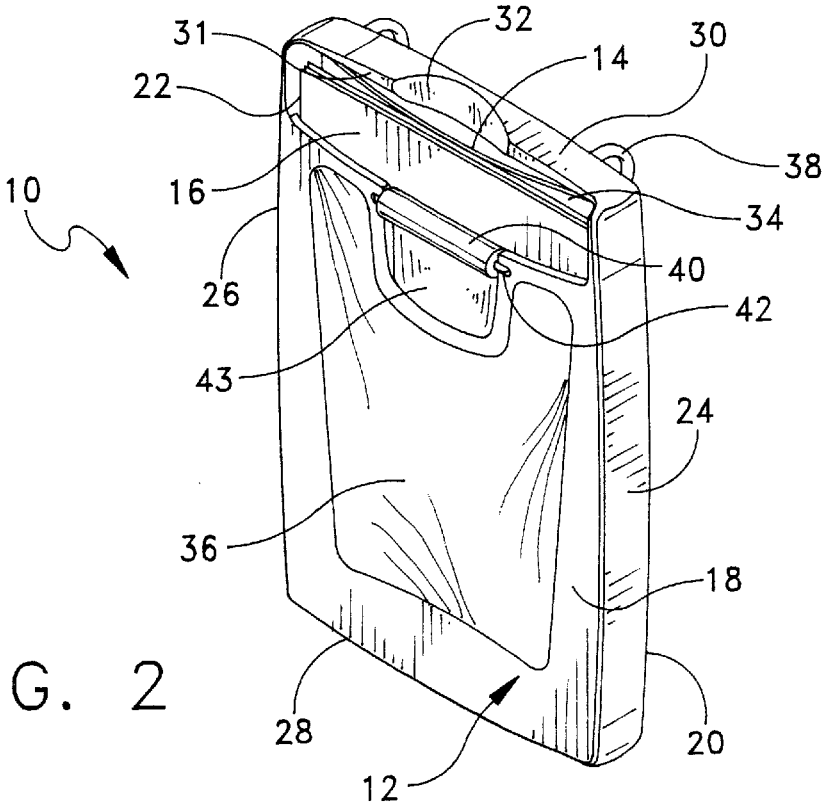
FIG. 2 is a perspective view showing the business card holder and dispensing device filled with a plurality of business cards.

Referring now to FIGS. 1 and 2, the card holder and dispenser 10 includes a housing 12 which defines a cavity 14 for receiving a plurality of business cards 16. The body of the housing 12 includes opposing front 18 and rear 20 walls wherein the front wall 18 has a window opening 22 formed therein, through which loading and unloading of business cards 16 takes place. The body of the housing 12 further includes opposing side walls 24 and 26 and a bottom wall 28 which interconnect the front 18 and rear 20 walls of the housing 12. A top wall provides an exit rail 30 adjacent the top of the window opening 22 for separating the cards 16 when they are dispensed from the cavity 14 of the housing 12. A portion of the top edge of the exit rail 30 is cut away as at 32 providing easier access when loading and unloading the cards 16 to and from the cavity 14 of the housing 12. A bow spring 34 (FIGS. 4–6) is positioned within the cavity 14 of the housing 12 for biasing the business cards 16 upwardly against a roller mechanism which permits dispensing of the cards 16, one at a time, from the cavity 14 of the housing 12. The front wall 18 may include a wood grain finish 36 providing for a more aesthetically pleasing appearance, and the rear wall 20 has a clip 38 (FIGS. 7–8) mounted thereon which enables the device to be clipped onto a selectively desirable area of the user's clothing, if so desired.

Figure 3:
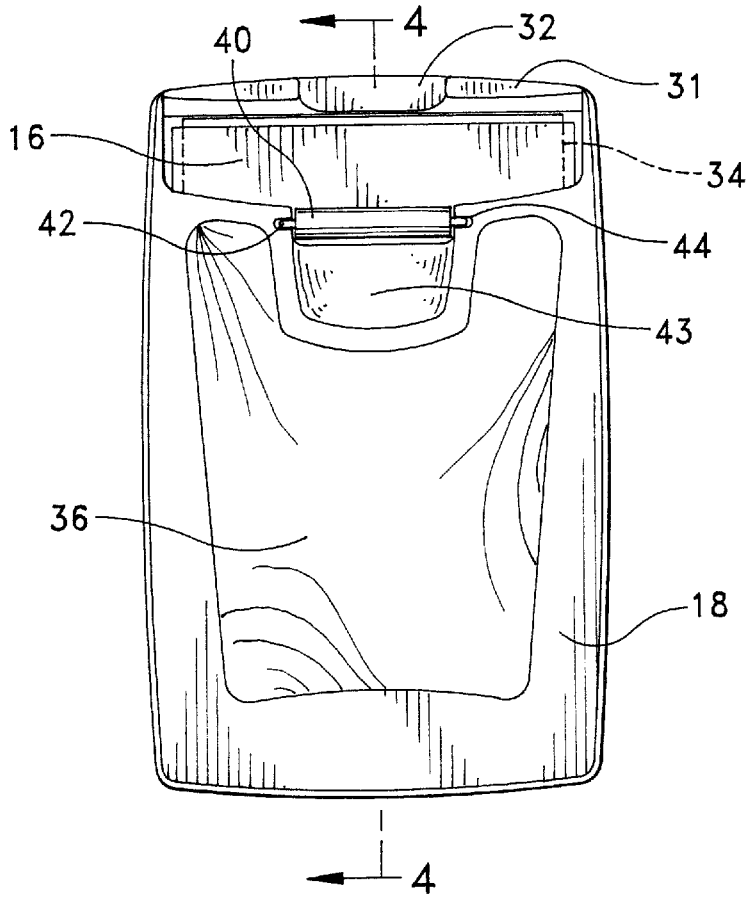
FIG. 3 is a front view thereof.

Referring now to FIGS. 2–3, the roller mechanism for actuating dispensing of the business cards 16 from the cavity 14 of the housing 12 is more clearly depicted. The roller mechanism includes a friction roller 40 which is rotatably mounted to the front wall 18 of the housing 12 adjacent the bottom of the window opening 22. The roller 40 has a pair of pins 42 outwardly extending from opposing ends thereof that are received in opposing notches 44 formed in the front wall 18 of the housing 12. The arrangement is such that the bow spring 34 located in the cavity 14 of the housing 12 biases the plurality of business cards 16 upwardly against the roller 40 of the roller mechanism wherein downward (clockwise) rotation of the roller 40 frictionally feeds the top-most card 16 upward and out of the cavity 14 of the housing 12. Specific dimensional relationships between the exit rail 30 and roller mechanism allow the top-most card 16 to be neatly stripped and dispensed through the window opening 22 formed in the front wall 18 of the housing 12. A recess 43 is formed in the front wall 18 of the housing 12 below the roller 42 for facilitating actuation of the roller mechanism by the user's thumb 46 as most clearly shown in FIG. 5.

Figure 4:
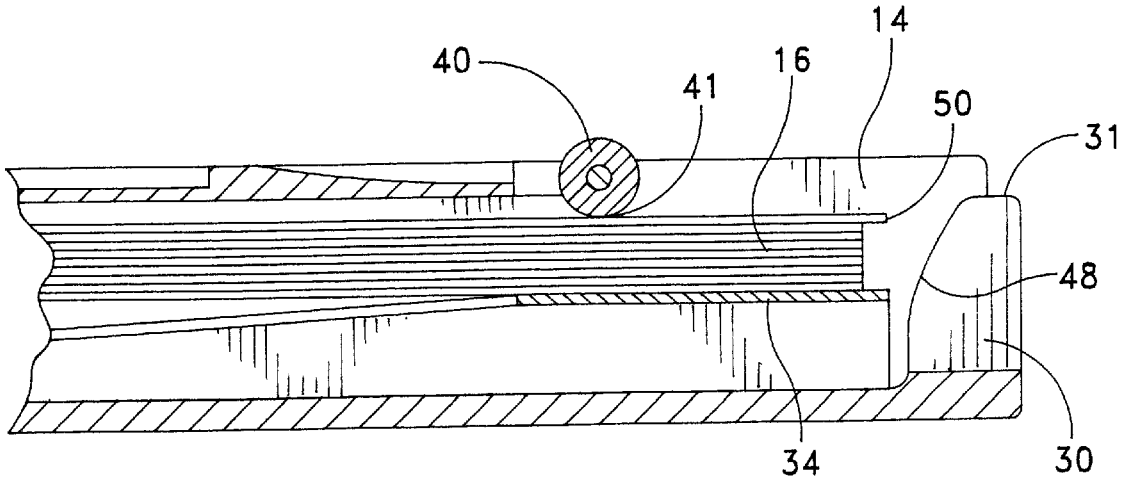
FIG. 4 is an enlarged cross-sectional view taken along line 4—4 of FIG. 3.
Figure 5:
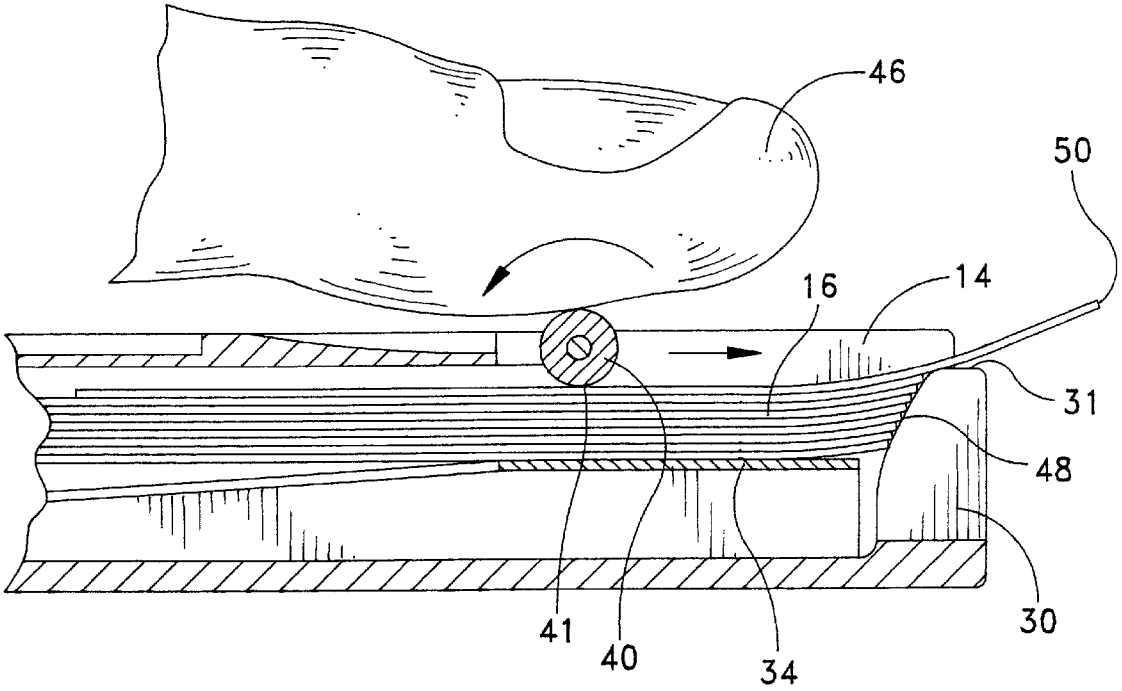
FIG. 5 is a cross-sectional view as shown in FIG. 4 showing a card being dispensed form the device.

Referring now to FIGS. 4–5, the relationship between the roller mechanism and exit rail 30 is more clearly depicted. An important aspect of the invention is the dimensional relationship between the roller mechanism and the exit rail 30 of the housing 12. Specifically, the top edge 31 of the exit rail 30 is slightly higher than the bottom surface 41 of the roller 40. It should be understood that the bottom surface 41 of the roller 40 determines the level of the top-most card 16 received within the cavity 14 of the housing 12. Hence, when the roller 40 is actuated by the user's finger or thumb 46 it forces the top-most card 16 outwardly against the curved or angled inner surface or side edge 48 of the exit rail 30. Since the top edge 31 of the exit rail 30 is higher than the bottom surface 41 of the roller 40, the leading edge 50 of the top-most card 16 contacts curved or angled side edge 48 of the exit rail 30 and is cammed upwardly and outwardly over top edge 31. An important aspect of the invention resides in the curvature of the side edge 48 of the exit rail 30 which makes it easier for the top-most card 16 to move upwardly and outwardly over the top edge 31 of the exit rail 30 and become neatly stripped from the stack of cards 16 remaining in the cavity 14 of the housing 12, thus preventing feeding of more than one card 16 at a time and jamming of cards 16 between the exit rail 30 and front wall 18 window opening 22. Also of importance is the fact that the bottom or inner surface 33 of exit rail 30 has a convex curvature from side to side when the holder 10 is viewed from the front as in FIGS. 3 and 6. Thus, when the leading edge 50 of top-most card 16 engages rail 30, the convex curvature of the latter minimizes engagement between edge 50 and rail 30 because only the center portion of the card will engage the rail. This reduces friction between the card and the rail which enables leading edge 50 to slide up and over top edge 31 more easily. Also, this curvature tends to direct the corners of the card being dispensed away from the corners of the housing, thus minimizing the likelihood of jamming that sometimes occurs when the card corners engage the housing corners.

Figure 6:
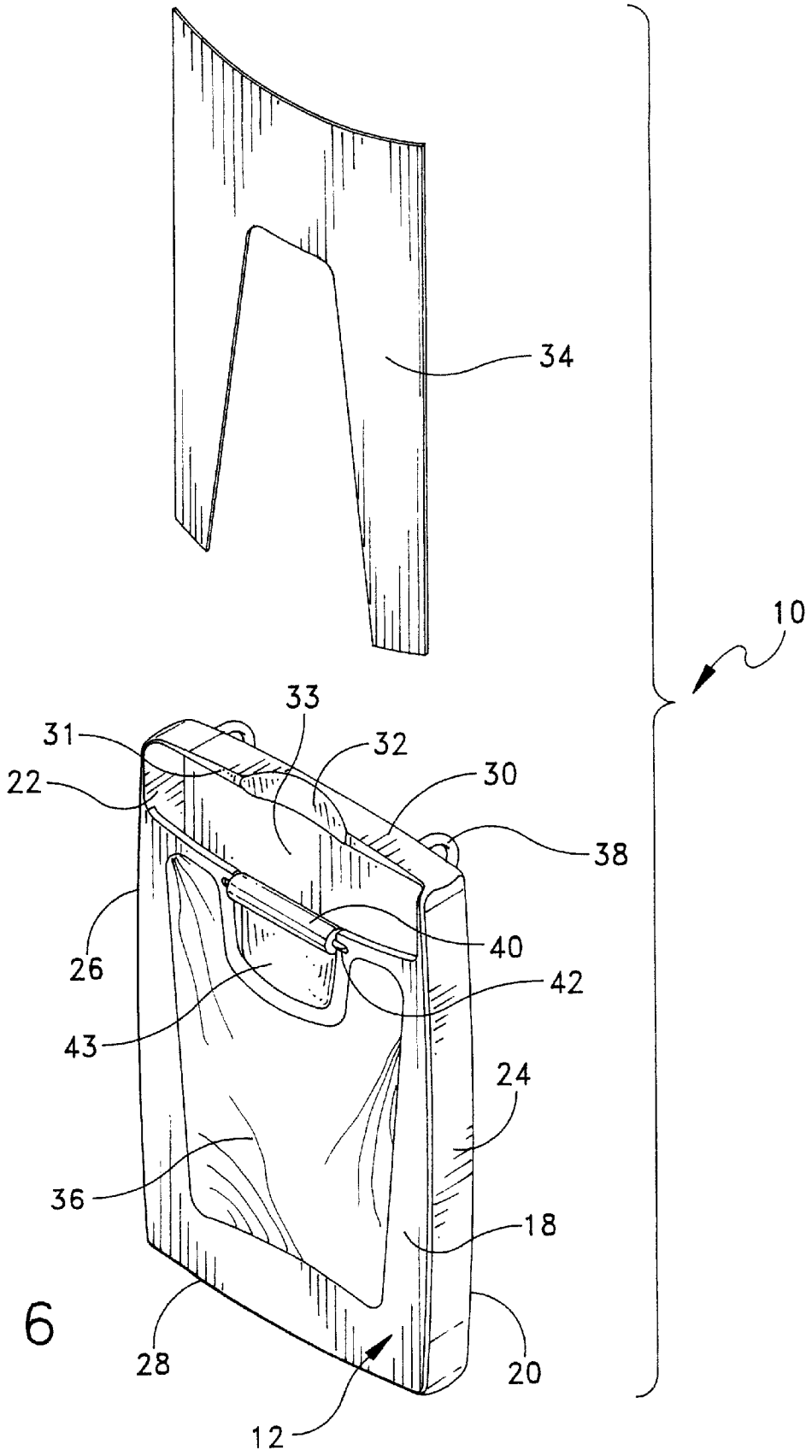
FIG. 6 is an exploded perspective view showing the leaf spring removed from the dispensing device housing.
Figure 7:
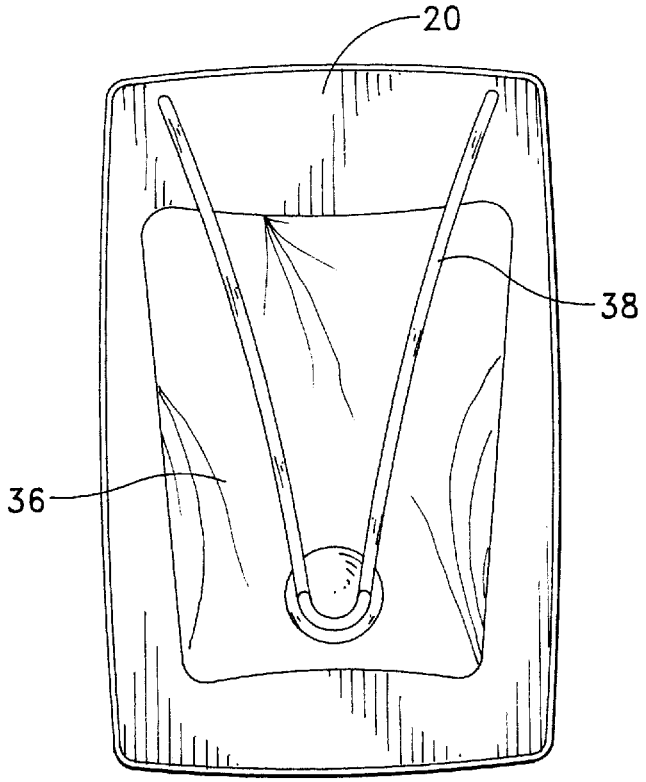
FIG. 7 is a rear view of the card holder and dispensing device of the instant invention.
Figure 8:
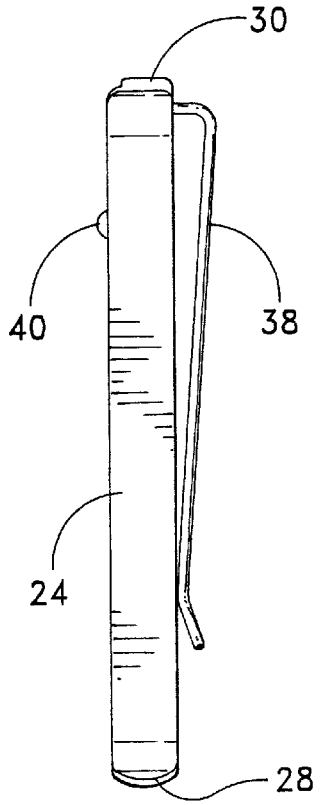
FIG. 8 is a side view thereof.

Referring now to FIG. 6, the bow spring 34 for biasing the business cards 16 upwardly against the roller 40 of the roller mechanism is shown removed from the cavity 14 of the housing 12 of the card holder 10. It should be understood, that the spring 34 may be easily removed from the cavity 14 of housing 12 but must be positioned therein in order for the device to work properly. Referring to FIGS. 7–8, a clip 38 is shown mounted to the rear wall 20 of the housing 12 of the holder 10. As previously discussed, the clip 38 is useful for mounting the card holder and dispenser 10 to a selected area of the user's clothing if it is desired to do so, rather than carrying it in the user's pocket or pocket-book.

It can therefore be seen that the card holder and dispensing device of the instant invention provides effective means for receiving a plurality of business cards and dispensing them one at a time from a cavity of the housing. The device includes a roller mechanism for actuating dispensing of the business cards and a curved exit rail which allows the cards to be neatly stripped from their stack without jamming during the dispensing procedure. The device is compact in size and may easily be carried in a person's pocket. In the alternative, a clip is mounted to the rear wall of the holder and may be used for clipping the holder to a desirable location on the user's clothes. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A card holder and dispensing device comprising:

a housing defining a cavity for receiving a plurality of stacked cards therein;

said housing having opposed front and back walls, opposed side walls, and opposed top and bottom walls;

said front wall having an opening therein adjacent said top wall for loading and dispensing cards to and from said cavity;

a roller mechanism rotatably mounted on said front wall and communicating with said cavity;

means in said housing for biasing said stack of cards against said roller mechanism, whereby actuation of said roller mechanism causes the top-most card of the stack to be forced against said top wall, and then upwardly and over the top edge of said top wall and outwardly through said opening; the inner surface of said top wall having a convex curvature from side to side thereby minimizing frictional engagement between the leading edge of the top-most card and said top wall inner surface during dispensing of the top-most card, and at the same time directing the corners of the card away from the corners of the housing, thereby minimizing jamming.

2. The card holder and dispensing device of claim 1, further characterized in that the top edge of said top wall is higher than the bottom of said roller mechanism thereby insuring that the top-most card engages the inner surface of said top wall before being dispensed.

3. The card holder and dispensing device of claim 2, further characterized in that the inner surface of said top wall is curved outwardly so that when engaged by said top-most card, the latter is cammed upwardly and outwardly over the top edge of said top wall.

4. A card holder and dispensing device as set forth in claim 1, wherein the top edge of said top wall has a cut-out portion formed therein for facilitating loading and removing cards from the cavity of the housing.

5. A card holder and dispensing device as set forth in claim 1, wherein the means for biasing said cards against said roller mechanism is a bow spring.

6. A card holder and dispensing device as set forth in claim 1, wherein said roller actuating mechanism is rotatably mounted to the front wall of the housing adjacent said opening.

7. A card holder and dispensing mechanism as set forth in claim 6, wherein said front wall of said housing further includes a recess formed therein beneath said roller mechanism for facilitating actuation of said roller mechanism.

* * * * *